US010556241B2

(12) United States Patent
Yoon et al.

(10) Patent No.: US 10,556,241 B2
(45) Date of Patent: Feb. 11, 2020

(54) SCROLL TYPE ELECTROSTATIC PRECIPITATOR AND AIR CONDITIONING APPARATUS HAVING THE SAME

(71) Applicant: SAMSUNG ELECTRONICS CO., LTD., Suwon-si (KR)

(72) Inventors: Ji-won Yoon, Suwon-si (KR); Kwang-seung Lee, Suwon-si (KR); Yasuhiko Kochiyama, Seongnam-si (KR); Hyong-soo Noh, Hwaseong-si (KR); In-chul Yun, Yongin-si (KR); Ki-sup Lee, Seongnam-si (KR); Il-yong Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 289 days.

(21) Appl. No.: 15/602,629

(22) Filed: May 23, 2017

(65) Prior Publication Data

US 2018/0015483 A1 Jan. 18, 2018

(30) Foreign Application Priority Data

Jul. 18, 2016 (KR) ..... 10-2016-0090912

(51) Int. Cl.
*B03C 3/45* (2006.01)
*B03C 3/60* (2006.01)

(52) U.S. Cl.
CPC . *B03C 3/45* (2013.01); *B03C 3/60* (2013.01)

(58) Field of Classification Search
CPC combination set(s) only.
See application file for complete search history.

(56) References Cited

U.S. PATENT DOCUMENTS 4,234,324 A 11/1980 Dodge, Jr.
4,313,741 A * 2/1982 Masuda ..... B03C 3/12 96/78
6,203,600 B1 * 3/2001 Loreth ..... B03C 3/49 96/40
6,338,382 B1 * 1/2002 Takahashi ..... F24F 1/0007 165/96
6,471,746 B2 * 10/2002 Hagglund ..... B03C 3/12 55/521

(Continued)

FOREIGN PATENT DOCUMENTS

EP 0129401 A1 6/1984
JP 2-174950 A 7/1990

(Continued)

OTHER PUBLICATIONS

Extended European search report dated Dec. 7, 2017 in corresponding European Patent Application No. 17173140.9. 11 pp.

*Primary Examiner* — Amber R Orlando
*Assistant Examiner* — Sonji Turner
(74) *Attorney, Agent, or Firm* — Staas & Halsey LLP

(57) ABSTRACT

An electrostatic precipitator is provided. The electrostatic precipitator includes an electrode part including a high voltage electrode with voltage applied thereto and a ground electrode coiled in a circumferential direction along with the high voltage electrode while being spaced apart from the high voltage electrode, and a plurality of turning flow paths inclined with respect to an axial direction of the electrode part between the high voltage electrode and the ground electrode.

20 Claims, 14 Drawing Sheets

(56) References Cited

U.S. PATENT DOCUMENTS

| | | | | |
|---|---|---|---|---|
| 7,077,890 | B2 * | 7/2006 | Botvinnik | B03C 3/08 96/69 |
| 7,854,900 | B2 * | 12/2010 | Takeda | A61L 9/22 361/230 |
| 8,349,052 | B2 * | 1/2013 | Noh | B03C 3/08 95/79 |
| 8,512,455 | B2 * | 8/2013 | Yasuhiko | B03C 3/86 96/69 |
| 8,597,415 | B2 * | 12/2013 | Noh | B03C 3/12 96/60 |
| 9,005,347 | B2 * | 4/2015 | Lev | B03C 3/011 96/39 |
| 2004/0226448 | A1 * | 11/2004 | Griffiths | B03C 3/14 96/67 |
| 2010/0071397 | A1 * | 3/2010 | Takeda | A61L 9/22 62/264 |
| 2010/0288127 | A1 | 11/2010 | Yasuhiko et al. | |
| 2012/0314333 | A1 * | 12/2012 | Takeda | A61L 9/22 361/230 |
| 2015/0182976 | A1 * | 7/2015 | Lev | B03C 3/011 96/84 |

FOREIGN PATENT DOCUMENTS

| | | | |
|---|---|---|---|
| JP | 3141434 | B2 | 3/2001 |
| JP | 3448447 | B2 | 9/2003 |
| KR | 20-0179856 | | 2/2000 |
| KR | 20-0179858 | | 2/2000 |
| KR | 10-152848 | B1 | 6/2015 |
| KR | 10-2016-0032617 | | 3/2016 |

* cited by examiner

FIG. 11

COMPARISON OF CLEAN AIR DELIVERY RATE (CADR) PERFORMANCE

| CONVENTIONAL SCROLL TYPE ELECTROSTATIC PRECIPITATOR | ELECTROSTATIC PRECIPITATOR ACCORDING TO PRESENT INVENTION |
|---|---|
| 290 $m^3$/h | 340 $m^3$/h |

FIG. 12

COMPARISON OF 1 PASS EFFICIENCY

| FLOW VELOCITY | CONVENTIONAL SCROLL TYPE ELECTROSTATIC PRECIPITATOR | ELECTROSTATIC PRECIPITATOR ACCORDING TO PRESENT INVENTION |
|---|---|---|
| 1 m/s | 90% | 97% |
| 1.5 m/s | 69% | 92% |

SCROLL TYPE ELECTROSTATIC PRECIPITATOR AND AIR CONDITIONING APPARATUS HAVING THE SAME

CROSS-REFERENCE TO RELATED APPLICATIONS

This application claims priority from Korean Patent Application No. 10-2016-0090912, filed on Jul. 18, 2016 in the Korean Intellectual Property Office, the disclosure of which is incorporated herein by reference in its entirety.

BACKGROUND OF THE INVENTION

Field of the Invention

Apparatuses and methods consistent with the present invention relate to an electrostatic precipitator for collecting fine dusts and an air conditioning apparatus including the same.

Description of the Related Art

A conventional electrostatic precipitator is classified into a plate type electrostatic precipitator and a scroll type electrostatic precipitator. The plate type electrostatic precipitator is configured in such a way that a high voltage electrode and a ground electrode are arranged to cross in the form of a plate. An electrode of the scroll type electrostatic precipitator includes a high voltage electrode and a ground electrode similarly to the plate type electrostatic precipitator but the high voltage electrode and the ground electrode are manufactured to be coiled in the form of a roll.

The scroll type electrostatic precipitator is manufactured in the form of a roll by rolling the high voltage electrode and the ground electrode together. In this case, an uneven part is formed on the ground electrode such that the high voltage electrode and the ground electrode are spaced apart at a predetermined interval. Air passes through a conductive substance and then passes between the electrodes and, in this case, the air is attached to the ground electrode to collect dusts.

However, the conventional scroll type electrostatic precipitator has a problem in that an electrode field is irregularly formed by an uneven part formed on the ground electrode and, accordingly, even if a high voltage electrode is insulated, the uneven part of the ground electrode is closely disposed to the high voltage electrode and, accordingly, it is difficult to apply a high voltage of 3 kV or more to the high voltage electrode. For this reason, collection efficiency of fine dusts of the scroll type electrostatic precipitator is lower than the plate type electrostatic precipitator.

In addition, in the conventional scroll type electrostatic precipitator, a longitudinal width by which an electric field functions is increased as the thickness of an electrostatic precipitator is increased and, accordingly, collection efficiency of fine dusts is increased. However, there is a limit in increasing the thickness of an electrostatic precipitator applied to an air conditioning apparatus such as an air cleaner and an air conditioner due to user needs for a slimmed and compact air conditioning apparatus and, accordingly, there is a problem in that is not easy to enhance collection efficiency of fine dusts.

SUMMARY OF THE INVENTION

Exemplary embodiments of the present invention overcome the above disadvantages and other disadvantages not described above. Also, the present invention is not required to overcome the disadvantages described above, and an exemplary embodiment of the present invention may not overcome any of the problems described above.

The present invention provides a scroll type electrostatic precipitator and an air conditioning apparatus including the same, for enhancing collection efficiency of fine dusts by increasing a length of a flow path in which fine dusts pass, and an air conditioning apparatus including the electrostatic precipitator.

According to an aspect of the present invention, an electrostatic precipitator includes an electrode part including a high voltage electrode with voltage applied thereto and a ground electrode coiled in a circumferential direction along with the high voltage electrode while being spaced apart from the high voltage electrode, and a plurality of turning flow paths inclined with respect to an axial direction of the electrode part between the high voltage electrode and the ground electrode.

The plurality of turning flow paths may be formed by a plurality of spaced members arranged at an interval between the high voltage electrode and the ground electrode.

The plurality of spaced members may be arranged to be inclined with respect to the axial direction of the electrode part.

The plurality of spaced members may be formed to be curved and inclination angle of the plurality of spaced members may be increased away from a center of the electrode part. In addition, an angle between an axis of the electrode part and a tangent line of each of the plurality of spaced members may be increased toward an outlet from an inlet of the electrode part.

An interval at which the plurality of spaced members is installed may be reduced outward from a center of the electrode part.

An interval of the plurality of spaced members may be reduced and an angle of the plurality of spaced members may be increased as velocity of charged particles introduced into the turning flow path is increased.

The plurality of spaced members may be arranged at a constant interval in a circumferential direction of the electrode part.

The spaced members may be formed of an insulating material.

The plurality of spaced members may be installed on opposite surfaces of the ground electrode or the high voltage electrode.

The ground electrode or the high voltage electrode may include a plurality of installation holes with the plurality of spaced members installed therein.

The plurality of spaced members may be fixed through the plurality of installation holes.

The plurality of spaced members may be fixed by any one of coupling via hook assembly and melt-adhering.

A thickness of each of the spaced members may be constant.

The turning flow path may be formed by a corrugated bending part integrally formed with the ground electrode.

According to another aspect of the present invention, an air conditioning apparatus includes a fanning part, a charger part configured to charge dust particles introduced from the fanning part, and an electrostatic precipitator adjacently disposed to the charger part and configured to collect the charged dust particles, wherein the electrostatic precipitator includes an electrode part including a high voltage electrode with voltage applied thereto and a ground electrode coiled in a circumferential direction along with the high voltage electrode and a plurality of spaced members configured to arrange the high voltage electrode and the ground electrode to be spaced apart from each other and configured to be arranged to be inclined with respect to an axial direction of the electrode part to form a turning flow path.

Additional and/or other aspects and advantages of the invention will be set forth in part in the description which follows and, in part, will be obvious from the description, or may be learned by practice of the invention.

BRIEF DESCRIPTION OF THE DRAWING FIGURES

The above and/or other aspects of the present invention will be more apparent by describing certain exemplary embodiments of the present invention with reference to the accompanying drawings, in which.

Figure 1:
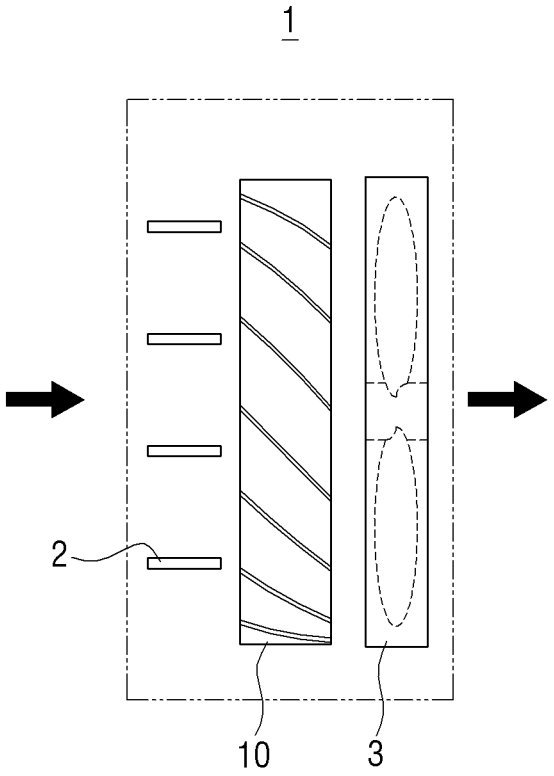
FIG. 1 is a schematic diagram illustrating an air conditioning apparatus including an electrostatic precipitator according to an exemplary embodiment of the present invention.

FIG. 11 is a comparative experimental result table of clean air delivery rate (CADR) performance between a prototype using an electrostatic precipitator according to the present invention and an air conditioning apparatus including a conventional scroll type electrostatic precipitator; and FIG. 12 is a comparative experimental result table of 1 pass efficiency between an electrostatic precipitator according to the present invention and a conventional plate type electrostatic precipitator.

DETAILED DESCRIPTION OF THE EXEMPLARY EMBODIMENTS

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed in the present invention. Similar reference numerals in the drawings denote like elements.

The terminology used herein is for the purpose of describing particular embodiments only and is not intended to be limiting of the inventive concept. As used herein, the singular forms "a," "an" and "the" are intended to include the plural forms as well, unless the context clearly indicates otherwise. All terms including technical and scientific terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein. Depending on the cases, even terminologies defined in the specification should not be interpreted as excluding exemplary embodiments of the present disclosure.

Hereinafter, a structure of an electrostatic precipitator and an air conditioning apparatus including an electrostatic precipitator will be described with regard to exemplary embodiments of the invention with reference to the attached drawings.

FIG. 1 is a schematic diagram illustrating an air conditioning apparatus 1 including an electrostatic precipitator 10 according to an exemplary embodiment of the present invention.

The air conditioning apparatus 1 may include a fan part 3 for forming wind, a charger part 2 for charging fine dusts, and the electrostatic precipitator 10.

The fan part 3 may include a fan for generating air flow. For example, the fan part 3 may include a mixed flow fan advantageous to generate a vortex. As a flow path of the vortex generated by the mixed flow fan is more similar to a flow path of the vortex generated by spaced members 110 of the electrostatic precipitator 10, flow resistance may be further lowered. Accordingly, a combination of the mixed flow fan and the electrostatic precipitator according to the present invention may help performance of the air conditioning apparatus 1.

When the fan part 3 is operated, fine dusts are introduced into the charger part 2 along with air. The charger part 2 may be a wire-type charger, a brush-type charger, a needle-type charger, or the like and may charge fine dusts introduced via corona discharge with ions. The fan part 3 may be installed on a front surface of the charger part 2 or installed on a rear surface of the electrostatic precipitator 10. That is, the fan part 3 may be installed on the front surface of the charger part 2 to supply air or may be installed on the rear surface of the electrostatic precipitator 10 to introduce air.

Fine dusts charged with positive ions may be collected by a ground electrode 220 according to an electric field formed in the electrostatic precipitator 10. The electrostatic precipitator 10 will be described below.

Figure 2:
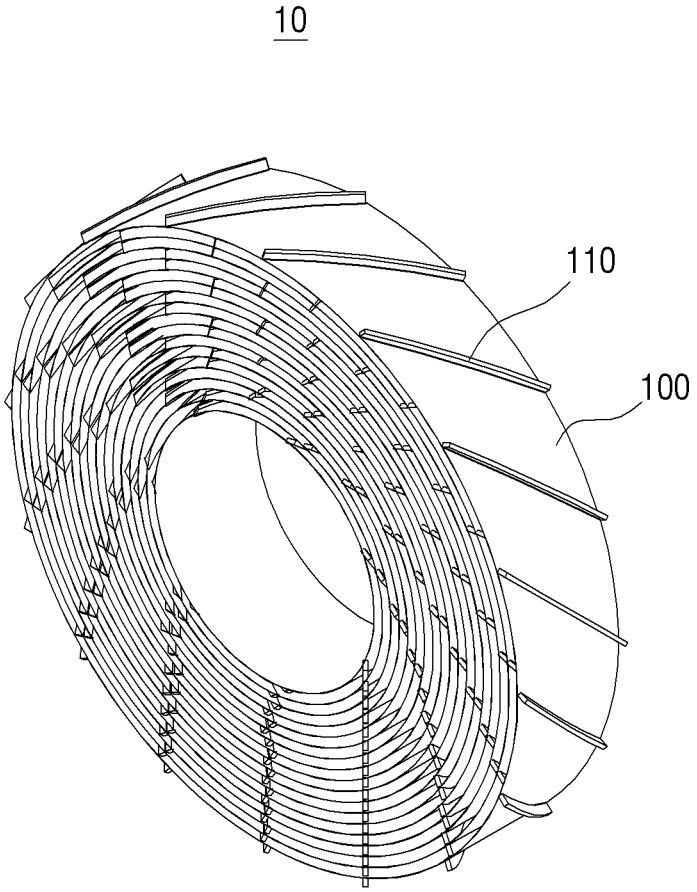
FIG. 2 is a schematic diagram illustrating an electrostatic precipitator according to an exemplary embodiment of the present invention.
Figure 3:
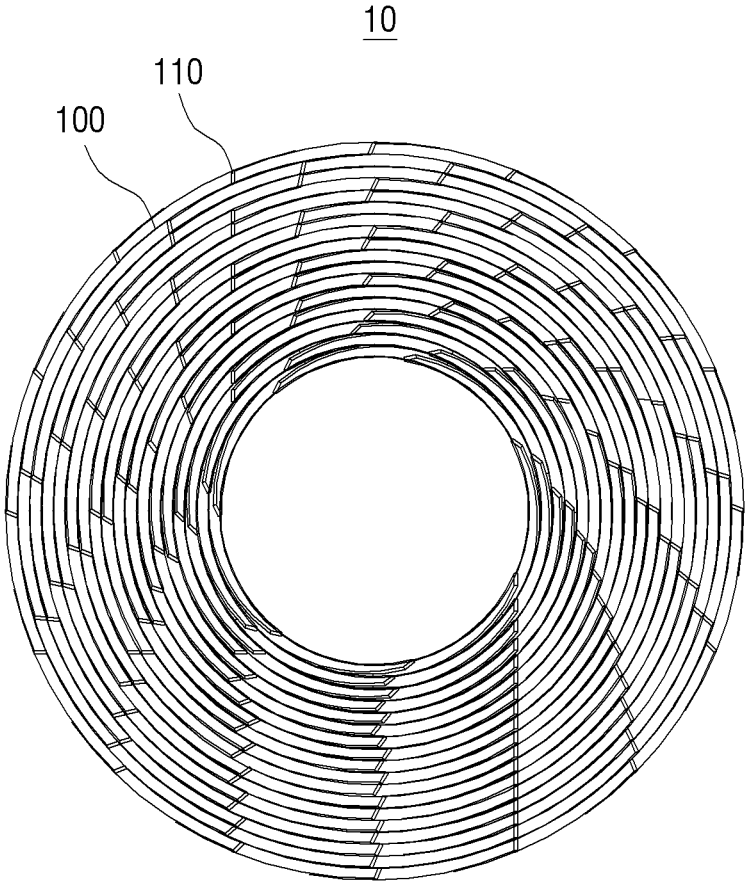
FIG. 3 is a plan view of an electrostatic precipitator according to an exemplary embodiment of the present invention.

FIGS. 2 and 3 are a schematic diagram and a plan view of the electrostatic precipitator 10 according to an exemplary embodiment of the present invention.

Referring to FIGS. 2 and 3, the electrostatic precipitator 10 may include a turning flow path 100 and an electrode part 200.

The electrode part 200 of the electrostatic precipitator 10 may include a high voltage electrode 210 and the ground electrode 220. The high voltage electrode 210 and the ground electrode 220 may be configured in the form of a thin plate. The high voltage electrode 210 and the ground electrode 220 configured in the form of a thin plate may be configured in the form of a scroll coiled in a circumferential direction together. The high voltage electrode 210 and the ground electrode 220 may be spaced apart at a predetermined interval.

The high voltage electrode 210 may be a conductive material, a semiconducting material, or an insulated conductive material and the ground electrode 220 may be formed of a conductive material such as aluminum.

The turning flow path 100 as a path for collecting fine dusts may be disposed between the high voltage electrode 210 and the ground electrode 220. In order to form a vortex from charged fine dusts and to increase an effective length that passes through an electric field, the turning flow path 100 may have inclination in an axial direction of the electrode part 200. The turning flow path 100 having inclination may form a vortex and the charged fine dusts may increase a moving path in the electric field.

The inclination of the turning flow path 100 may be formed by setting an angle corresponding to a vortex introduced by the fanning part.

Figure 4:
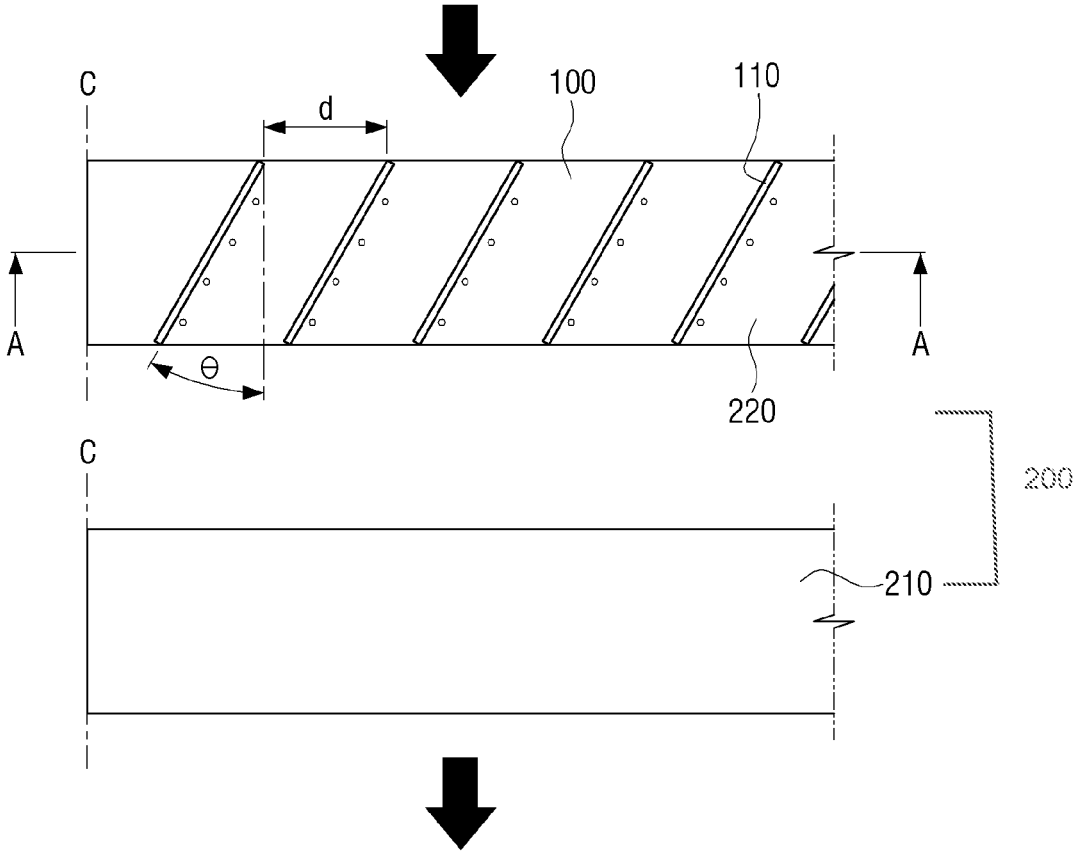
FIG. 4 is a planar figure of an electrostatic precipitator according to an exemplary embodiment of the present invention.

FIG. 4 is a planar figure of the electrostatic precipitator 10 according to an exemplary embodiment of the present invention.

Referring to FIG. 4, the spaced members 110 is attached to the ground electrode 220 and the high voltage electrode 210 is configured to correspond to the ground electrode 220. However, although the spaced members 110 are attached to the ground electrode 220 according to the present embodiment, the spaced members 110 may also be installed on the high voltage electrode 210.

The spaced members 110 may form the turning flow path 100 and allow the high voltage electrode 210 and the ground electrode 220 to be spaced apart from each other. In order to incline the turning flow path 100, the spaced members 110 may have an angle θ in an axial C direction of the electrode part 200. In addition, in order to configure turning flow paths at a predetermined interval, the spaced members 110 may have a constant interval d.

The spaced members 110 may maintain a constant distance between the high voltage electrode 210 and the ground electrode 220.

When an angle of the spaced members 110 with respect to a central axis is high, a length of the turning flow path is increased but flow of charged particles is obstructed. When the interval d of the spaced members 110 is reduced, resistance that obstructs movement of charged particles may be increased. Accordingly, the spaced members 110 may have an appropriate angle θ and interval d.

When flow velocity of charged particles is increased, a time period in which the charged particles pass through the electric field may be reduced. In this case, collection efficiency of charged particles may be lowered. Accordingly, when flow velocity is high, an angle of the spaced members 110 with respect to a central axis C may be reduced or an interval d of spaced members may be reduced, thereby increasing resistance against flow of charged particles.

On the other hand, when flow velocity is low, a time period in which charged particles pass through an electric field may be increased. In this case, when resistance is present, fine dusts may be accumulated on one place and, accordingly, flow velocity may be further reduced. Accordingly, it may be necessary to increase an angle of the spaced members 110 and to increase an interval d of spaced members so as to reduce resistance. However, when the interval d of spaced members is increased, the high voltage electrode 210 may drop and an interval between the high voltage electrode 210 and the ground electrode 220 may not be constant. Accordingly, the interval d of the spaced members 110 may be appropriately selected in order to maintain a constant interval between the high voltage electrode 210 and the ground electrode 220.

Accordingly, the appropriate angle θ and interval d needs to be set to increase collection efficiency of fine dusts under a condition of maintaining flow velocity of charged particles and an interval between electrodes.

The interval between the high voltage electrode 210 and the ground electrode 220 may be constantly maintained by the spaced members 110. The interval may be maintained to uniformly distribute an electric field between electrodes. The spaced members 110 may not allow current to flow between the high voltage electrode 210 and the ground electrode 220 using an insulating material. Therethrough, a higher voltage may be applied to the high voltage electrode 210 than a scroll type and, accordingly, it may be possible to collect fine dusts with high efficiency.

The spaced members 110 may be formed of a ductile material. Therethrough, during assembly of the electrostatic precipitator 10, the high voltage electrode 210 and the ground electrode 220 may not be deformed.

Figure 5:
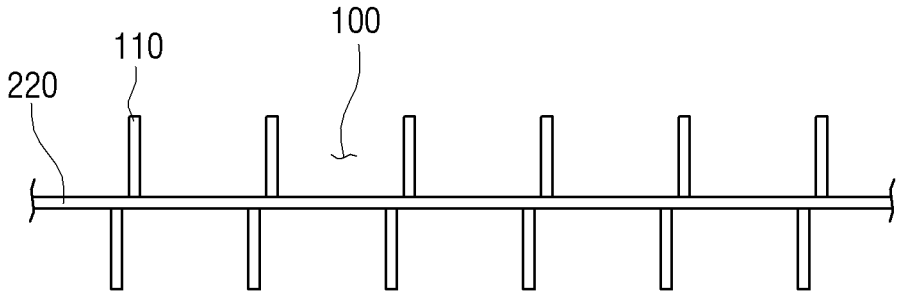
FIG. 5 is a cross-sectional view taken along a line A-A of FIG. 4.

FIG. 5 is a cross-sectional view taken along a line A-A of FIG. 4.

Referring FIG. 5, the spaced members 110 may be attached to opposite surfaces of the ground electrode 220 in order to maintain a predetermined interval from the high voltage electrode 210 that is adjacently disposed to each of the opposite surfaces of the ground electrode 220 when the high voltage electrode 210 and the ground electrode 220 are coiled in the form of a scroll.

Figure 6:
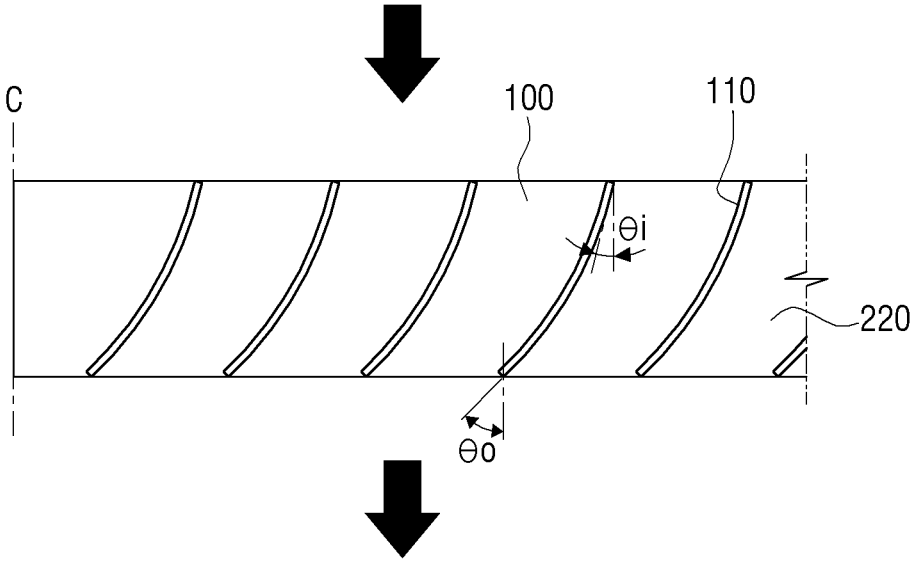
FIG. 6 is a planar figure of a ground electrode when spaced members are curved in an electrostatic precipitator according to an exemplary embodiment of the present invention.

FIG. 6 is a planar figure of the ground electrode 220 when the spaced members 110 are curved in an electrostatic precipitator according to an exemplary embodiment of the present invention.

The spaced members 110 may be curved such that the turning flow path 100 is curved. The curved turning flow path may further increase a moving distance of fine dusts in an electric field than an inclined turning flow path. That is, toward an outlet from an inlet of the electrode part 200, an angle θ between a central axis C and a tangent line of each point of the spaced members 110 may be further increased. An angle θi at the inlet may be increased to an angle θo at the outlet and, accordingly, the spaced members 110 may form a curved line.

Figure 7:
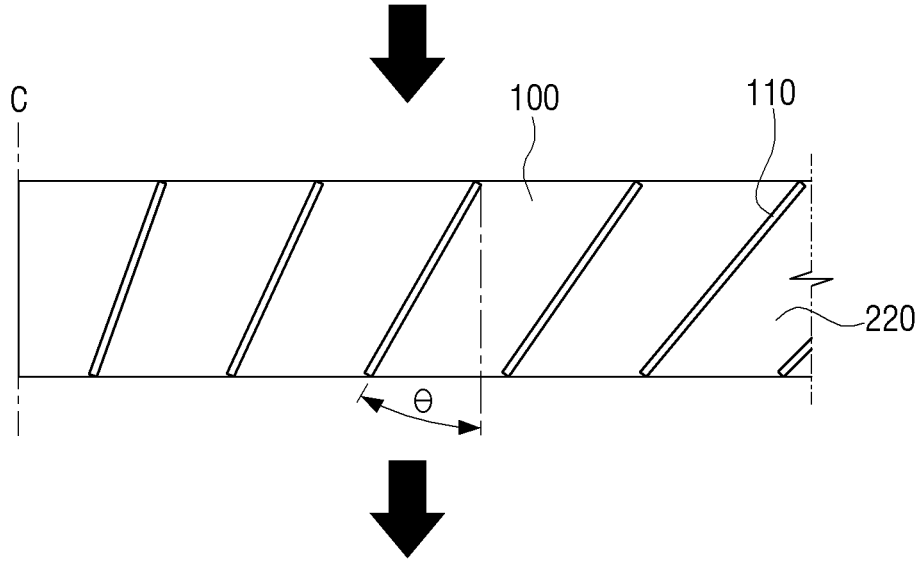
FIG. 7 is a planar figure of a ground electrode when spaced members have different angles in an axial direction in an electrostatic precipitator according to an exemplary embodiment of the present invention.

FIG. 7 is a planar figure of a ground electrode when the spaced members 110 have different angles θ in an axial direction in the electrostatic precipitator 10 according to an exemplary embodiment of the present invention.

As described above, an angle of each of the spaced members 110 may be set according to flow velocity of charged particles. A vortex may be formed by a mixed flow fan and charged particles may be introduced into the electrostatic precipitator 10 in the form of a spiral. A cross section of a fan at an outer peripheral side is large than a central part of the fan and, accordingly, flow velocity of air is high at the outer peripheral side of the fan.

Accordingly, as illustrated in FIG. 7, toward an outer peripheral side from a center of the electrostatic precipitator 10, an angle θ with respect to a central axis of the spaced members 110 may be increased to increase collection efficiency.

Figure 8:
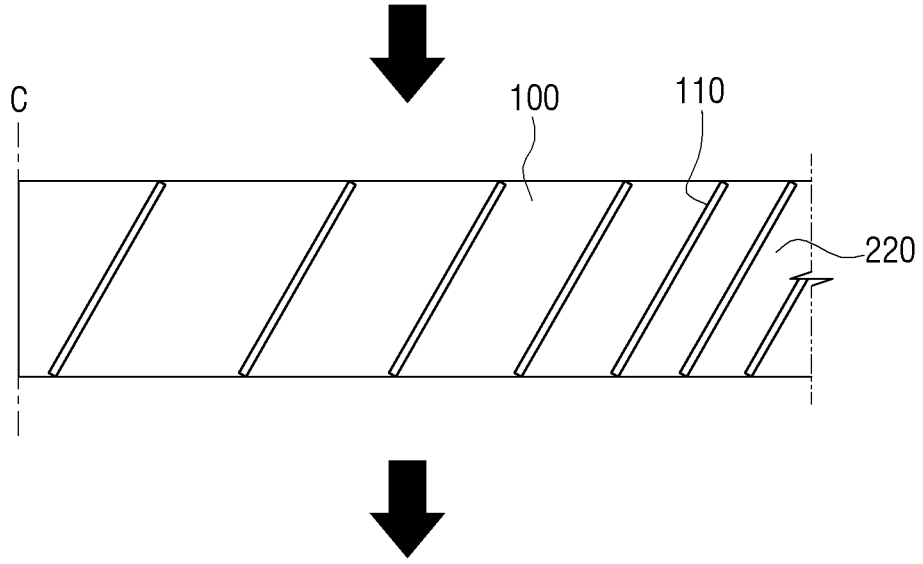
FIG. 8 is a planar figure of a ground electrode when spaced members have different intervals in an electrostatic precipitator according to an exemplary embodiment of the present invention.

FIG. 8 is a planar figure of a ground electrode when the spaced members 110 have different intervals in the electrostatic precipitator 10 according to an exemplary embodiment of the present invention.

Flow velocity is high at an outer peripheral side of the electrostatic precipitator 10 and, thus, the spaced members 110 may be further densely arranged to appropriately adjust flow velocity in order to increase resistance. Accordingly, toward an outer peripheral side from a center of the electrostatic precipitator 10, an interval d between the spaced members 110 may be narrowed.

Figure 9A:
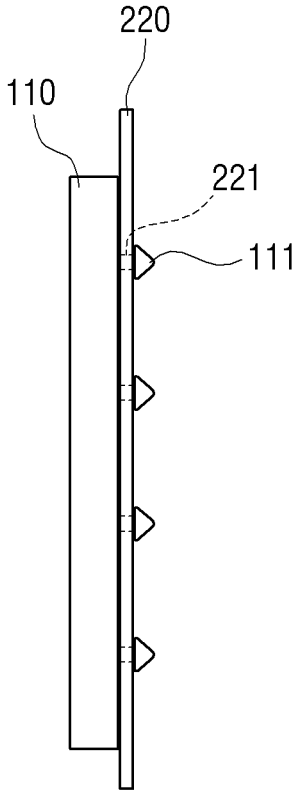
FIGS. 9A and 9B are diagrams illustrating coupling via hook assembly and melt-adhering.
Figure 9B:
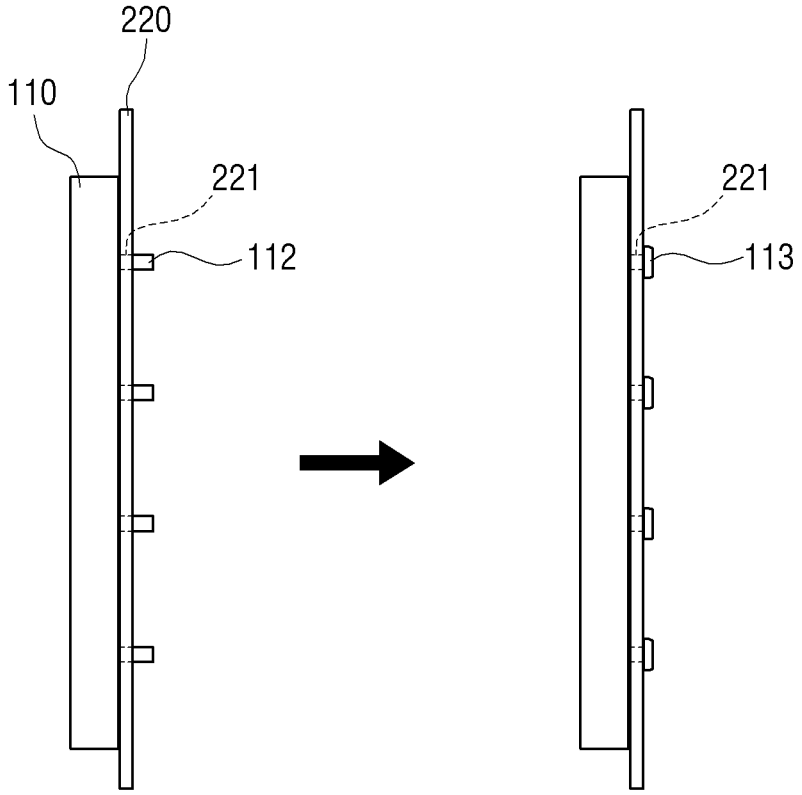

FIGS. 9A and 9B are diagrams illustrating coupling via hook assembly and melt-adhering.

FIG. 9A illustrates the case in which the spaced members 110 have hooks 111. The spaced members 110 having the hooks 111 are arranged through installation holes 221 of the ground electrode 220. After the spaced members 110 are arranged through the ground electrode 220, the hooks 111 of the spaced members may be fixed by the installation holes 221 and coupled to the ground electrode 220.

FIG. 9B illustrates the case in which the spaced members 110 are coupled to installation holes 221 via melt-adhering. First, installation parts 112, 113 of the spaced members 110 are arranged thorough the installation holes 221. The spaced members 110 may be fixed to the installation holes 221 by melting the installation parts 112, 113 and may be coupled to the ground electrode 220.

Figure 10A:
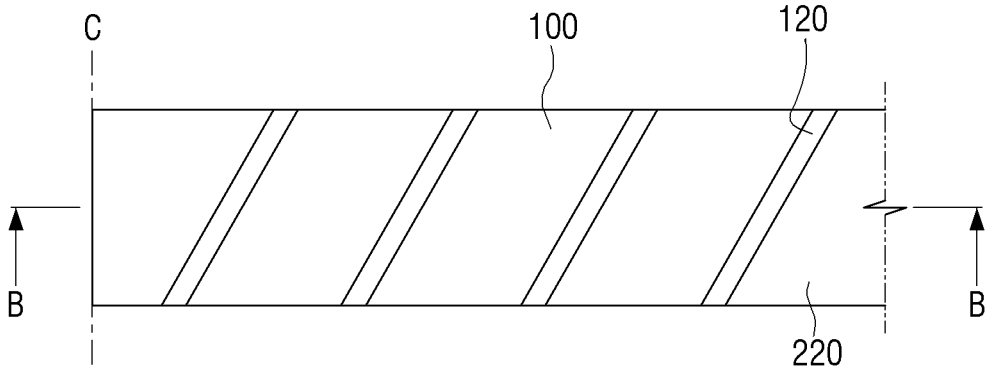
FIGS. 10A and 10B are a planar figure and a cross-sectional view of a ground electrode having a corrugated bending part of an electrostatic precipitator according to another exemplary embodiment of the present invention.
Figure 10B:
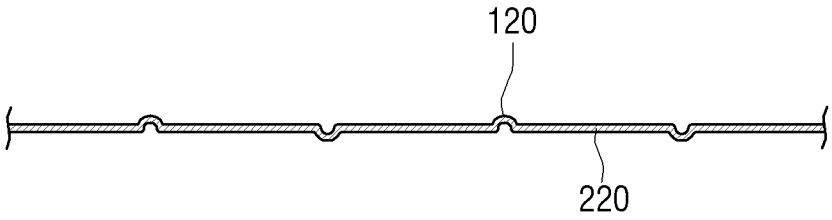

FIG. 10A is a planar figure of a ground electrode having a corrugated bending part of an electrostatic precipitator according to another exemplary embodiment of the present invention. FIG. 10B is a cross-sectional view taken along a line B-B of FIG. 10A.

A turning flow path may be formed using a corrugated bending part 120 instead of the spaced members 110. When the corrugated bending part 120 is used, the turning flow path may be formed to have a predetermined angle θ in order to form a vortex.

Hereinafter, the above configured air conditioning apparatus 1 and electrostatic precipitator 10 according to an exemplary embodiment of the present invention may be operated as follows.

When the fan part 3 inside the air conditioning apparatus 1 is operated, fine dusts are introduced from an inlet of the air conditioning apparatus 1. The introduced fine dusts may be high-voltage discharged in the charger part 2 and may be charged with positive ions.

After passing through the charger part 2, fine dusts charged with ions may be moved to the electrostatic precipitator 10.

In the electrode part 200 of the electrostatic precipitator, a high voltage may be applied to the high voltage electrode 210 to form a strong electric field between the high voltage electrode 210 and the ground electrode 220. Fine dusts charged with ions may be introduced into an electric field area by the electrode part 200. The charged fine dusts may be collected to the ground electrode 220 while passing through the electric field.

As a time point in which the charged fine dusts pass through the electric field is further increased, that is, as an effective length of the electrostatic precipitator 10 is further increased, collection efficiency is enhanced. In order to increase an effective length by which the charged fine dusts pass the electric field, the turning flow path 100 may have inclination in an axial direction of the electrode part 200. The charged fine dusts introduced into the turning flow path 100 may form a vortex and the fine dusts may turn in a spiral form according to drag of flow.

As an effective length by which the charged fine dusts passes the electric field is further increased, residence time in an electric field area is further increased. When residence time is increased, a similar effect of increasing a thickness of the electrostatic precipitator is obtained. Accordingly, collection efficiency of fine dusts may be enhanced.

Air from which fine dusts are removed by the electrostatic precipitator 10 may be discharged out of the air conditioning apparatus 1.

FIG. 11 is a comparative experimental result table of clean air delivery rate (CADR) performance between a prototype using an electrostatic precipitator according to the present invention and an air conditioning apparatus including a conventional scroll type electrostatic precipitator.

The experiment is performed with the same components as all components such as a charging apparatus and a fanning part except for an electrostatic precipitator. In the experiment, a thickness of the conventional scroll type electrostatic precipitator is 120 mm and, even if the thickness of the electrostatic precipitator according to the present invention is halved to 60 mm, CADR performance is 50 $m^3/h$, which is high compared with the conventional case.

FIG. 12 is a comparative experimental result table of 1 pass efficiency between an electrostatic precipitator according to the present invention and a conventional plate type electrostatic precipitator.

The drawing shows collection efficiency of a 0.3 μm particle size under a surface velocity condition (1 to 1.5 m/s) in a rating driving condition range of an air conditioning apparatus. Discharging current of a charging apparatus is 100 μA that is the same condition. Collection efficiency of the electrostatic precipitator according to the present invention is higher than the conventional plate type electrostatic precipitator in any case. In particular, it may be seen that the electrostatic precipitator according to the present invention has higher efficiency than the plate type electrostatic precipitator in the case of flow at high speed.

As described above, the turning flow path 100 may be inclined to increase an effective length that passes through an electric field. Therethrough, a longitudinal length may be reduced compared with the conventional electrostatic precipitator and an electrostatic precipitator may be slimmed to reduce a total thickness of an air conditioning apparatus. An interval between the high voltage electrode 210 and the ground electrode 220 may be constantly maintained by the spaced members 110. An electrode distance with a predetermined interval may equalize intensity of an electric field in the electrostatic precipitator 10. In addition, as high voltage may be applied to the high voltage electrode 210 as possible, enhancing collection efficiency compared with the conventional scroll type electrostatic precipitator.

In addition, the electrostatic precipitator according to the present invention may be manufactured to be rolled in a scroll form like the conventional electrostatic precipitator and a manufacturing process may be simplified.

The foregoing exemplary embodiments and advantages are merely exemplary and are not to be construed as limiting the present invention. The present teaching can be readily applied to other types of apparatuses. Also, the description of the exemplary embodiments of the present invention is intended to be illustrative, and not to limit the scope of the claims, and many alternatives, modifications, and variations will be apparent to those skilled in the art.

What is claimed is:

1. An electrostatic precipitator comprising:

an electrode part including a high voltage electrode with voltage applied thereto and a ground electrode coiled in a circumferential direction along with the high voltage electrode while being spaced apart from the high voltage electrode; and a plurality of turning flow paths formed between the high voltage electrode and the ground electrode and inclined with respect to an axial direction of the electrode part.

2. The electrostatic precipitator as claimed in claim 1, wherein the plurality of turning flow paths are formed by a plurality of spaced members arranged at an interval between the high voltage electrode and the ground electrode.

3. The electrostatic precipitator as claimed in claim 2, wherein the plurality of spaced members are arranged to be inclined with respect to the axial direction of the electrode part.

4. The electrostatic precipitator as claimed in claim 3, wherein the plurality of spaced members are formed to be curved.

5. The electrostatic precipitator as claimed in claim 4, wherein an angle between an axis of the electrode part and a tangent line of each of the plurality of spaced members is increased toward an outlet from an inlet of the electrode part.

6. The electrostatic precipitator as claimed in claim 3, wherein an inclination angle of the plurality of spaced members are increased away from a center of the electrode part.

7. The electrostatic precipitator as claimed in claim 3, wherein the plurality of spaced members are spaced apart at a constant interval.

8. The electrostatic precipitator as claimed in claim 3, wherein an interval at which the plurality of spaced members are installed is reduced outward from a center of the electrode part.

9. The electrostatic precipitator as claimed in claim 2, wherein an interval of the plurality of spaced members is reduced and an angle of the plurality of spaced members is increased as velocity of charged particles introduced into the plurality of turning flow paths is increased.

10. The electrostatic precipitator as claimed in claim 2, wherein the plurality of spaced members are arranged at a constant interval in a circumferential direction of the electrode part.

11. The electrostatic precipitator as claimed in claim 2, wherein the spaced members are formed of an insulating material.

12. The electrostatic precipitator as claimed in claim 2, wherein the plurality of spaced members are installed on opposite surfaces of the ground electrode or the high voltage electrode.

13. The electrostatic precipitator as claimed in claim 2, wherein the ground electrode or the high voltage electrode comprises a plurality of installation holes with the plurality of spaced members installed therein.

14. The electrostatic precipitator as claimed in claim 13, wherein the plurality of spaced members are fixed through the plurality of installation holes.

15. The electrostatic precipitator as claimed in claim 13, wherein the plurality of spaced members are attached by any one of coupling via hook assembly and melt-adhering.

16. The electrostatic precipitator as claimed in claim 2, wherein a thickness of each of the plurality of spaced members is constant.

17. The electrostatic precipitator as claimed in claim 1, wherein the plurality of turning flow paths are formed by a corrugated bending part integrally formed with the ground electrode.

18. An air conditioning apparatus comprising:

a fan part;

a charger part configured to charge dust particles introduced from the fan part; and an electrostatic precipitator adjacently disposed to the charger part and configured to collect the charged dust particles, wherein the electrostatic precipitator comprises:

an electrode part including a high voltage electrode with voltage applied thereto and a ground electrode coiled in a circumferential direction along with the high voltage electrode; and a plurality of spaced members configured to arrange the high voltage electrode and the ground electrode to be spaced apart from each other, wherein the plurality of spaced members are arranged to be inclined with respect to an axial direction of the electrode part to form a turning flow path between the high voltage electrode and the ground electrode.

19. The air conditioning apparatus as claimed in claim 18, wherein the plurality of turning flow paths are formed by the plurality of spaced members arranged at an interval between the high voltage electrode and the ground electrode.

20. The air conditioning apparatus as claimed in claim 18, wherein the plurality of spaced members are arranged at a constant interval in a circumferential direction of the electrode part.

* * * * *